US006360512B1

(12) United States Patent
Marois et al.

(10) Patent No.: US 6,360,512 B1
(45) Date of Patent: Mar. 26, 2002

(54) MACHINE AND METHOD FOR FASTENING A LOAD

(75) Inventors: Yanick Marois, Ascot Corner; Glen Ditchburn, Ayer's Cliff, both of (CA)

(73) Assignee: Wulftec International Inc., Quebec (CA)

( * ) Notice: Subject to any disclaimer, the term of this patent is extended or adjusted under 35 U.S.C. 154(b) by 0 days.

(21) Appl. No.: 09/427,908

(22) Filed: Oct. 27, 1999

(51) Int. Cl.[7] ..... B65B 13/02
(52) U.S. Cl. ..... 53/399; 53/589
(58) Field of Search ..... 53/211, 203, 399, 53/417, 449, 507, 587, 588, 589; 493/25

(56) References Cited

U.S. PATENT DOCUMENTS

| | | | | |
|---|---|---|---|---|
| 4,271,657 A | | 6/1981 | Lancaster, III et al. | 53/399 |
| 4,299,076 A | | 11/1981 | Humphrey | 53/587 |
| 4,432,185 A | | 2/1984 | Gelsinger | 53/138 |
| 4,631,898 A | | 12/1986 | Brambilla | 53/399 |
| 4,691,497 A | | 9/1987 | Lancaster | 53/399 |
| 4,831,812 A | | 5/1989 | Cocher et al. | 53/399 |
| 5,005,335 A | | 4/1991 | Yourgalite et al. | 53/399 |
| 5,054,263 A | | 10/1991 | Mäki-Rahkola et al. | 53/399 |
| 5,107,657 A | | 4/1992 | Diehl et al. | 53/141 |
| 5,168,691 A | | 12/1992 | Errani | 53/587 |
| 5,301,493 A | | 4/1994 | Chen | 53/556 |
| 5,408,808 A | | 4/1995 | Masuda et al. | 53/556 |
| 5,423,163 A | | 6/1995 | Wendt | 53/556 |
| 5,450,709 A | | 9/1995 | Steding | 53/465 |
| 5,463,843 A | * | 11/1995 | Sharp | 53/399 |
| 5,606,849 A | | 3/1997 | Bettenhausen | 53/556 |
| 5,623,808 A | | 4/1997 | Franklin et al. | 53/399 |
| 5,628,167 A | | 5/1997 | Huson et al. | 53/465 |
| 5,701,722 A | | 12/1997 | Franklin et al. | 53/399 |
| 5,787,691 A | | 8/1998 | Turfan et al. | 53/588 |
| 5,794,418 A | | 8/1998 | Lai | 53/556 |
| 5,802,810 A | | 9/1998 | Wojcik et al. | 53/399 |
| 5,836,140 A | | 11/1998 | Lancaster, III | 53/399 |

* cited by examiner

*Primary Examiner*—Rinaldi I. Rada
*Assistant Examiner*—Nathaniel Chukwurah
(74) *Attorney, Agent, or Firm*—Myers Bigel Sibley & Sajovec, P.A.

(57) ABSTRACT

The machine and the method are for fastening a load. The machine comprises a machine frame positioned around a central axis, a delivering carriage including an output delivering device for delivering a flexible material as a rope, first controllable moving device for producing a relative radial movement of the output delivering device with respect to the central axis, a second controllable moving device for producing a relative rotating movement of the rope with respect to the central axis, a third controllable moving device for producing a relative axial movement of rope in a direction parallel to the central axis, and a controller for controlling the relative radial movement by means of the first controllable moving device in view of the size of the load, and the relative rotating and axial movements by means of the second and third controllable moving devices to fasten the load with the rope.

7 Claims, 22 Drawing Sheets

MACHINE AND METHOD FOR FASTENING A LOAD

FIELD OF THE INVENTION

The present invention relates to a machine and a method for fastening a load. More particularly, the present invention relates to the fastening of the load by means of a rope made from a roll of flexible material such as for example plastic film.

BACKGROUND OF THE INVENTION

The load can be for example a metal coil on a pallet. According to the prior art, such a metal coil is strapped down on the pallet by means of steel straps. Then, sometimes, the metal coil is further wrapped by means of a stretched film to protect it during transportation or in the case where it is stored outside. The strapping of the metal coil on the pallet by means of steel straps is done manually or automatically.

Known in the art, there is the U.S. Pat. No. 4,271,657 granted on Jun. 9, 1981 to Patrick R. LANCASTER, III. This patent describes an apparatus and process for automatically making a spiral wrapped unitary package having a ring type or tied closure. In the apparatus, a series of loads, each containing a plurality of units are fed one load at a time onto a turntable adjacent a material dispenser with the leading edge of the material from the dispenser being formed into a rope-like configuration by a roper mechanism and held by a clamp mechanism mounted on the turntable. The material is open to its full web width, stretched and is spirally wrapped around the load at which time it is again formed into another rope-like configuration by the roper mechanism, and is positioned adjacent the leading edge where it is mechanically joined to the leading edge of the material by a ring type or tied closure. The roped material is then released from the clamp mechanism mounted on the turntable and the material is allowed to return to its memory position. The clamp mechanism again clamps the leading edge for the next load and the material is severed from the wrapped load.

Also known in the art, there is the U.S. Pat. No. 5,107,657 granted on Apr. 28, 1992 to Werner K. DIEHL et al. This patent describes an apparatus for wrapping a pallet load with a wrapping film applied selectively as a film rope or as a film sheet. The load is supported in an elevated position. A rotary arm supported above the load is arranged to be rotatably driven. An upright member depending from the rotary arm is spaced outwardly from the load in any rotary arm position. A carriage is arranged to be upwardly and downwardly driven along such member. A dispenser on the carriage dispenses the wrapper as a rope or as a sheet. A guide, which comprises a lever and a hook on the lever, is moveable among extended, partly retracted, and fully retracted positions. In the extended position, the guide guides the rope across the respective corners of the load. In the partly retracted position, the guide does not interfere with driving the carriage along the upright member.

Also known in the art, there is the U.S. Pat. No. 4,631,898 granted on Dec. 30, 1986 to Dario BRAMBILLA. This patent describes a process and an apparatus for continuously wrapping a palletized load, a self-propelling apparatus is provided, said apparatus being fitted with means for electric traction fed by batteries, said machine moving at a distance around the outer perimeter of a load.

Also known in the art, there are the following U.S. patents which describe different methods and apparatuses for wrapping a load: U.S. Pat. Nos. 4,299,076; 4,432,185; 4,691,497; 4,831,812; 5,005,335; 5,054,263; 5,168,691; 5,301,493; 5,408,808; 5,423,163; 5,450,709; 5,606,849; 5,623,808; 5,628,167; 5,701,722; 5,794,418; 5,787,691; 5,802,810; and 5,836,140.

None of the above-mentioned patents provides the necessary means for fastening loads having a large range of sizes, rapidly and efficiently.

It is an object of the present invention to provide a method and a machine for fastening loads having range of sizes larger than those of the prior art, in a rapid and efficient manner.

SUMMARY OF THE INVENTION

According to the present invention, there is provided a machine for fastening a load having a given size, comprising:

a machine frame positioned around a central axis intersecting a point where, in operation, the load is brought;

a delivering carriage onto which a roll of flexible material is rotatively mountable, including an output delivering means for delivering the flexible material as a rope;

first controllable moving means for producing a relative radial movement of the output delivering means with respect to the central axis;

a second controllable moving means for producing a relative rotating movement of the rope with respect to the central axis;

a third controllable moving means for producing a relative axial movement of rope in a direction parallel to the central axis; and controlling means for controlling:

the relative radial movement by means of the first controllable moving means in view of the size of the load; and the relative rotating and axial movements by means of the second and third controllable moving means to fasten the load with the rope once the radial movement has been produced.

Also according to the present invention, there is provided a method for fastening a load having a given size, comprising:

(a) bringing the load to a point intersected by a central axis;

(b) after step (a), producing a relative radial movement of an output delivering means with respect to the central axis in view of the size of the load, the output delivering means being for delivering a flexible material;

(c) delivering the flexible material as a rope by means of the output delivering means;

(d) after steps (b) and (c), producing a relative rotating movement of the rope with respect to the central axis; and (e) during step (d), producing a relative axial movement of rope in a direction parallel to the central axis to fasten the load with the rope by means of the relative rotating and axial movements thereof.

The objects, advantages and other features of the present invention will become more apparent upon reading of the following non-restrictive description of a preferred embodiment thereof, given for the purpose of exemplification only with reference to the accompanying drawings.

DETAILED DESCRIPTION OF THE DRAWINGS

Figure 1:
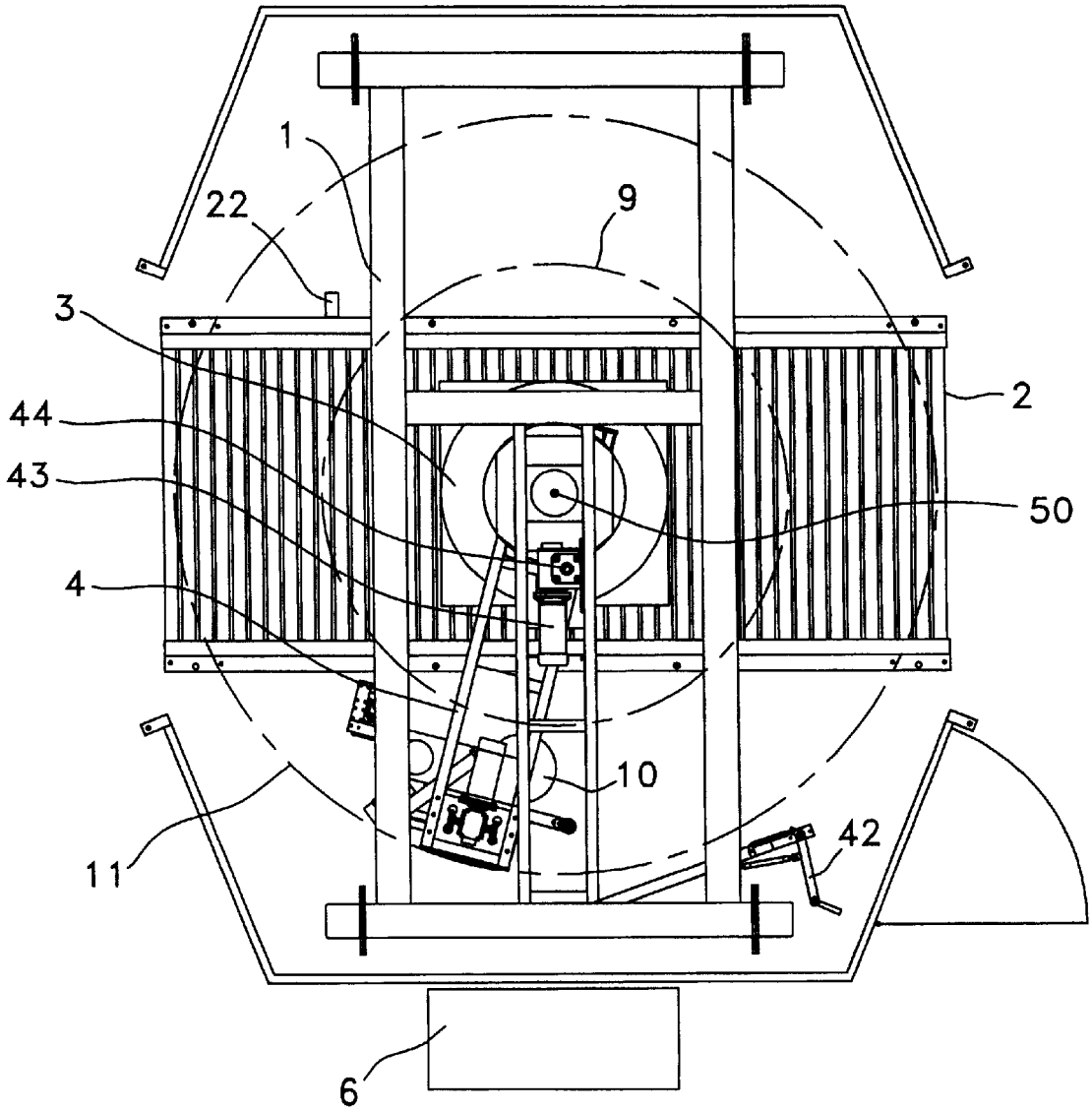
FIG. 1 is a top view of a machine for fastening a load according to the present invention, wherein there are also shown the load to be wrapped and a conveyor to bring the load in position to be wrapped.
Figure 2:
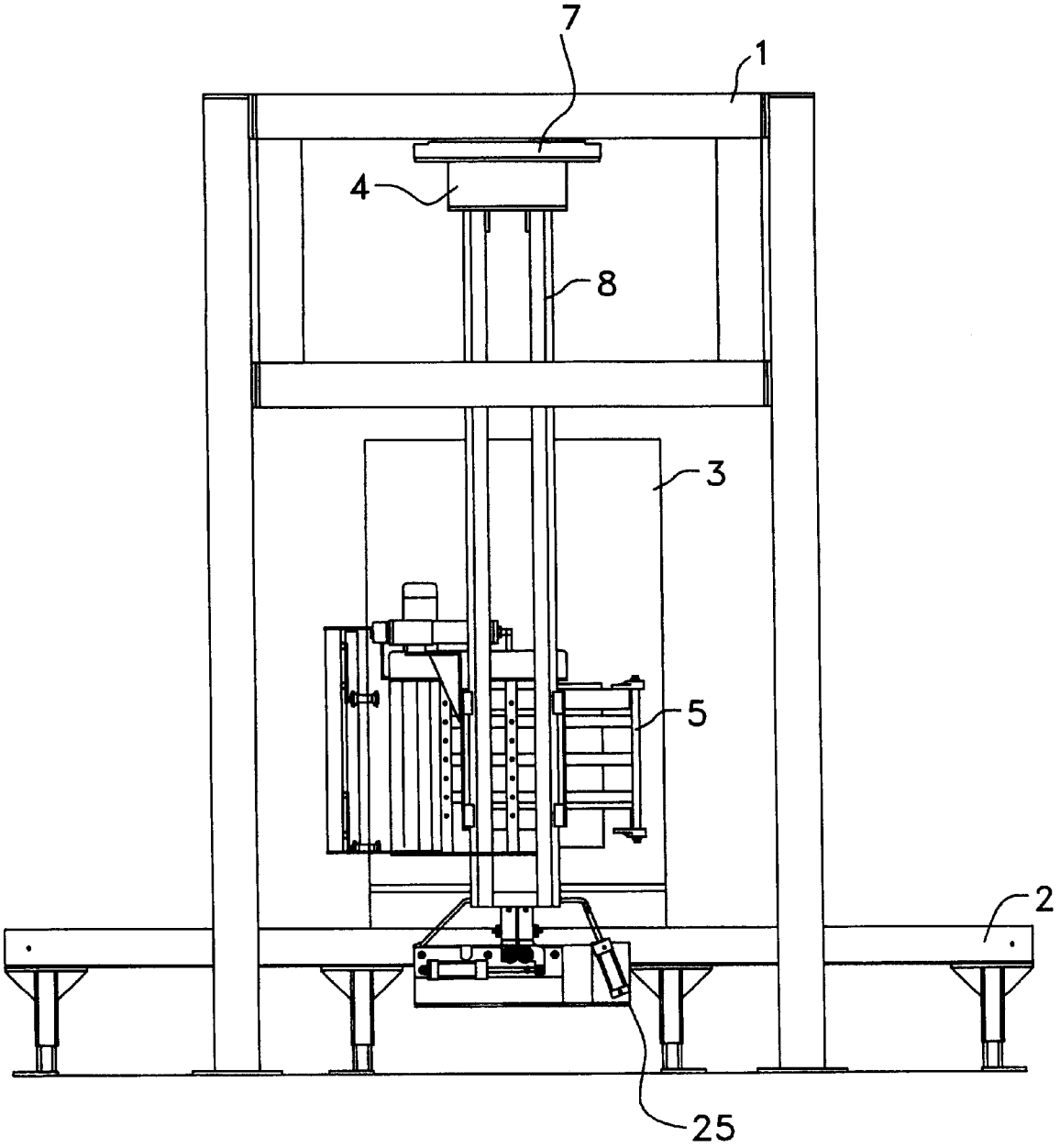
FIG. 2 is a side elevational view of the machine shown in FIG. 1.
Figure 3:
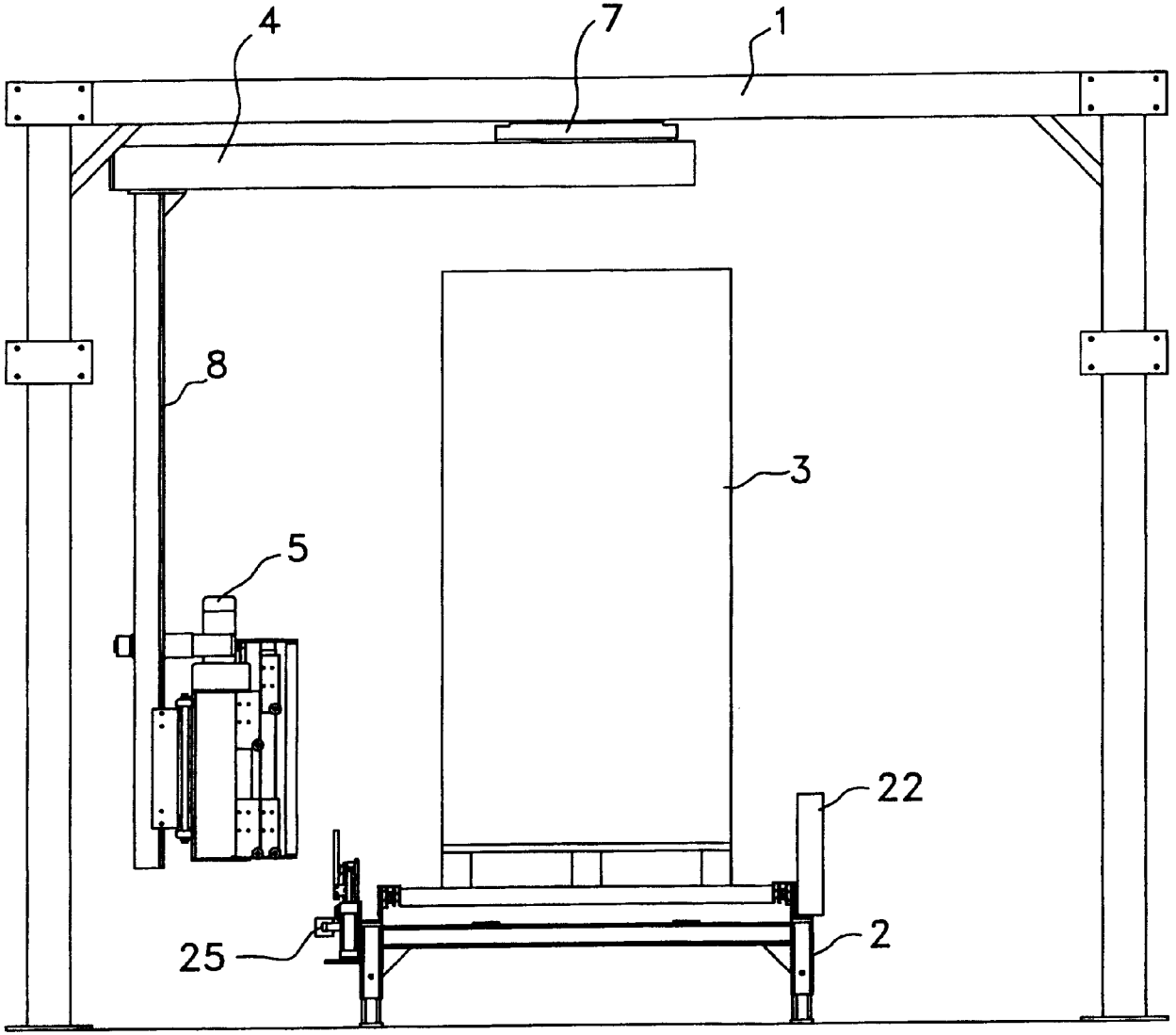
FIG. 3 is a rear elevational view of the machine shown in FIG. 1.

Referring now to FIGS. 1 to 3, there is shown a machine for fastening a load 3 according to the present invention. This machine can also be used to wrap the load 3. More specifically, the machine shown in these figures is an automatic stretch wrapping machine where a delivering carriage 5 revolves around the load 3 to fasten it. In the present case, the delivering carriage 5 revolves around the load 3 but, in an alternative embodiment, the load 3 can be rotated with respect to the machine.

The machine comprises a frame 1 positioned around a central axis 50 intersecting the point where, in operation, the load 3 is brought by means of a conveyor 2. The delivering carriage 5 includes a flexible material delivering system. The flexible material can be for example plastic film. A roll 10 of plastic film is rotatively mounted on the carriage 5. The carriage 5 includes an output delivering device for delivering the film as a rope. The delivering carriage 5 and the output delivering device will be described with more details in reference to FIGS. 4 to 9.

The machine also comprises a first controllable moving device for producing a relative radial movement of the output delivering device with respect to the central axis 50. This first controllable moving device will be described with more details in reference to FIGS. 10 to 13.

The machine also comprises a second controllable moving device for producing a relative rotating movement of the rope with respect to the central axis 50. The second controllable moving device comprises a motor 43, a ring gear 7 connected to the motor 43 and mounted within a gear box 44, a rotary arm 4 connected to the ring gear 7 and a boom 8 onto which the delivering carriage 5 is mounted. In operation, the relative rotating movement of the rope with respect to the central axis 50 is produced by rotating the delivering carriage 5 by means of the motor 43.

The machine also comprises a third controllable moving device for producing a relative axial movement of the rope in a direction parallel to the central axis 50. This third controllable moving device will be described with more details in reference to FIGS. 8 and 9.

The machine also comprises a controller for controlling the relative radial movement by means of the first controllable moving device in view of the size of the load, and the relative rotating and axial movements by means of the second and third controllable moving devices to fasten the load with the rope once the radial movement has been produced. This controller will be described with more details in reference to FIG. 22. The controller is located in the control panel 6.

As can be seen more specifically in FIG. 1, the maximum wrapping diameter is indicated by reference numeral 9. The outside diameter which is indicated by reference numeral 11 is the periphery of the rotating movement of the delivering carriage 5.

The machine further comprises a photocell 22 mounted on the conveyor 2 in a position nearby the point where the load 3 is located. The photocell 22 is for producing an output signal in relation to the size of the load 3. The photocell 22 has an output connected to the controller for sending its output signal thereto.

Figure 17:
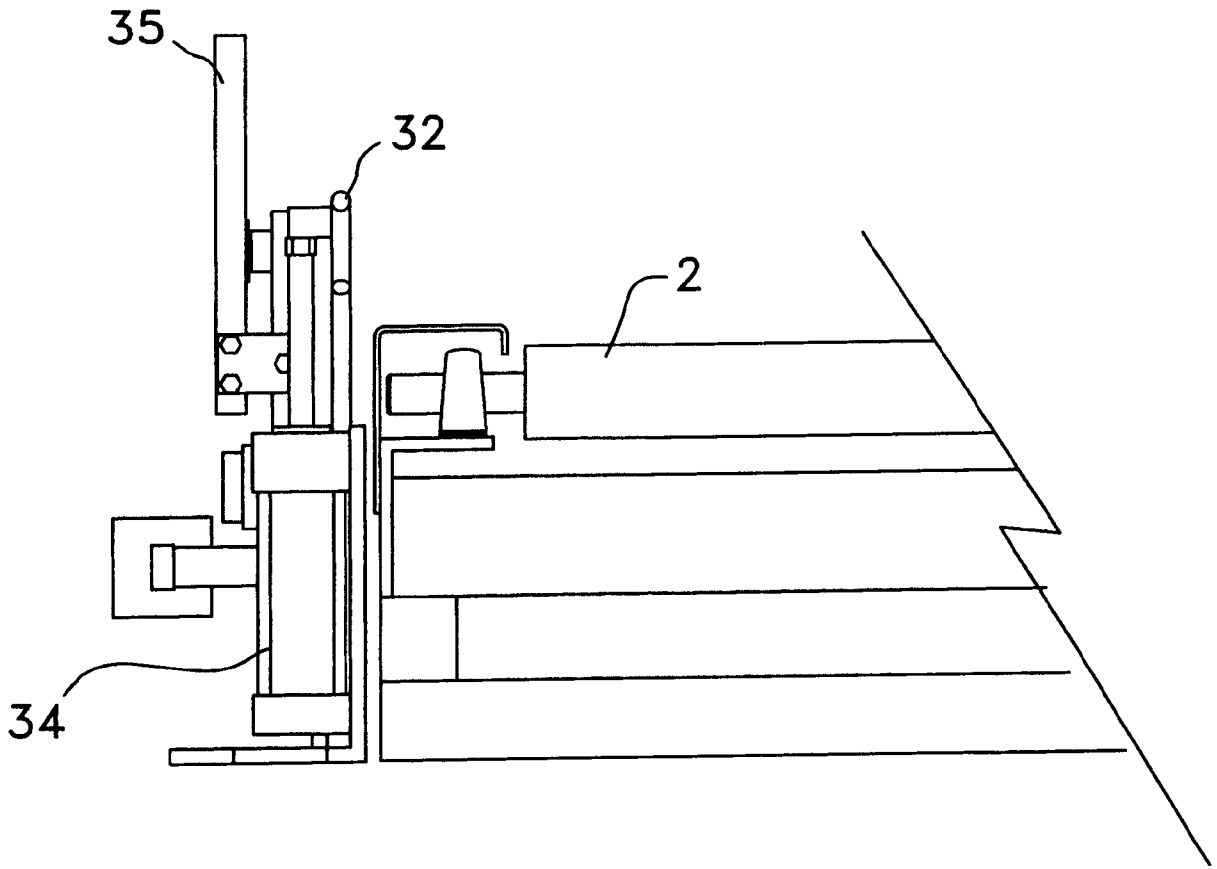
FIG. 17 is a rear elevational view of the part shown in FIG. 16.

Referring now more specifically to FIGS. 2 and 3, there is shown the clamp unit 25 which will be described with more details in reference to FIGS. 14 and 17. Referring now more specifically to FIG. 1, there is also shown a cut and wipe unit 42 which is a standard device for an automatic stretch wrapping machine. The function of this cut and wipe unit 42 is to cut and wipe the film at the end of a fastening or wrapping sequence. As this cut and wipe unit 42 is not part of the present invention, it will not be described with more details.

Figure 6:
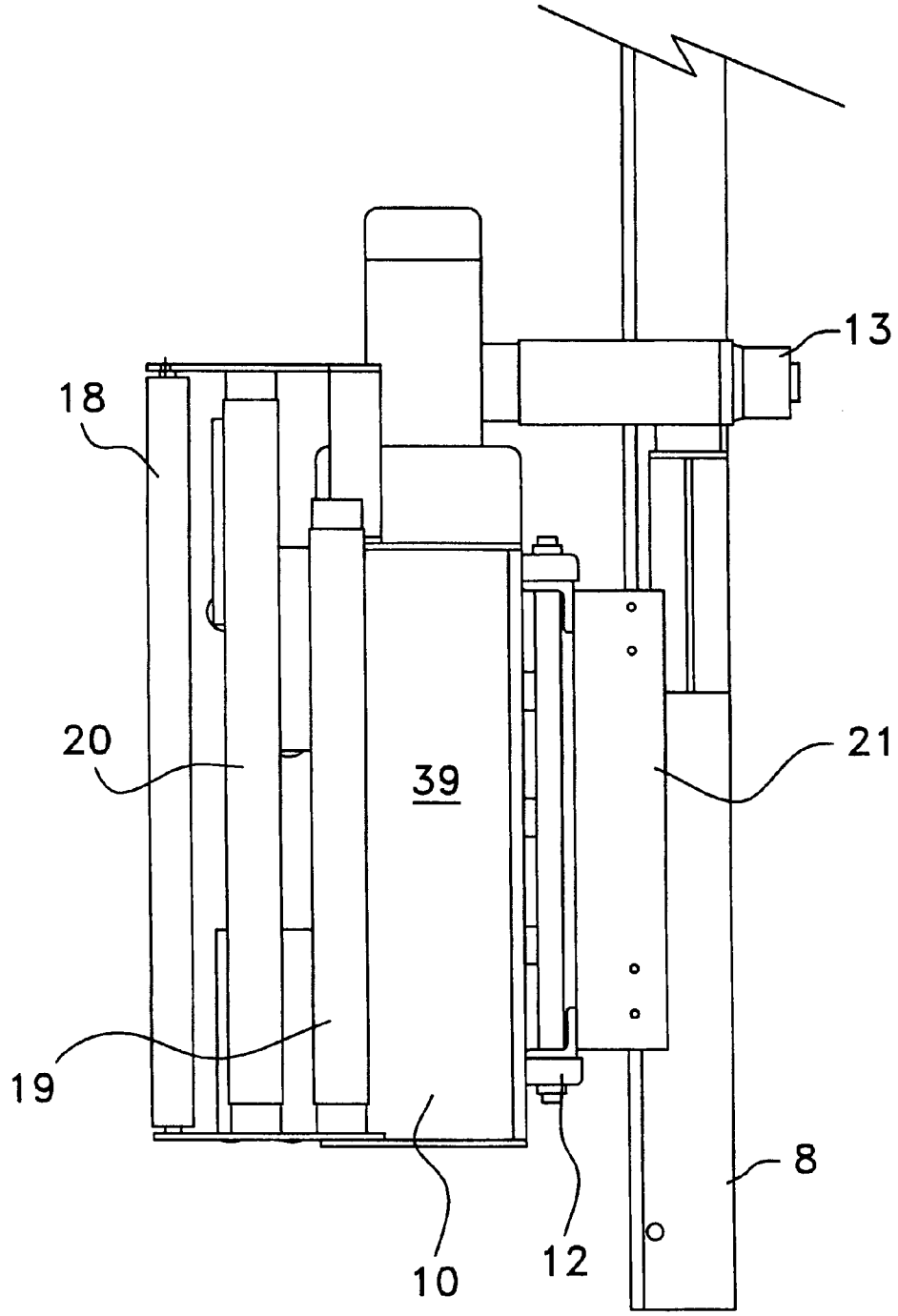
FIG. 6 is a front view of the part shown in FIG. 5.
Figure 7:
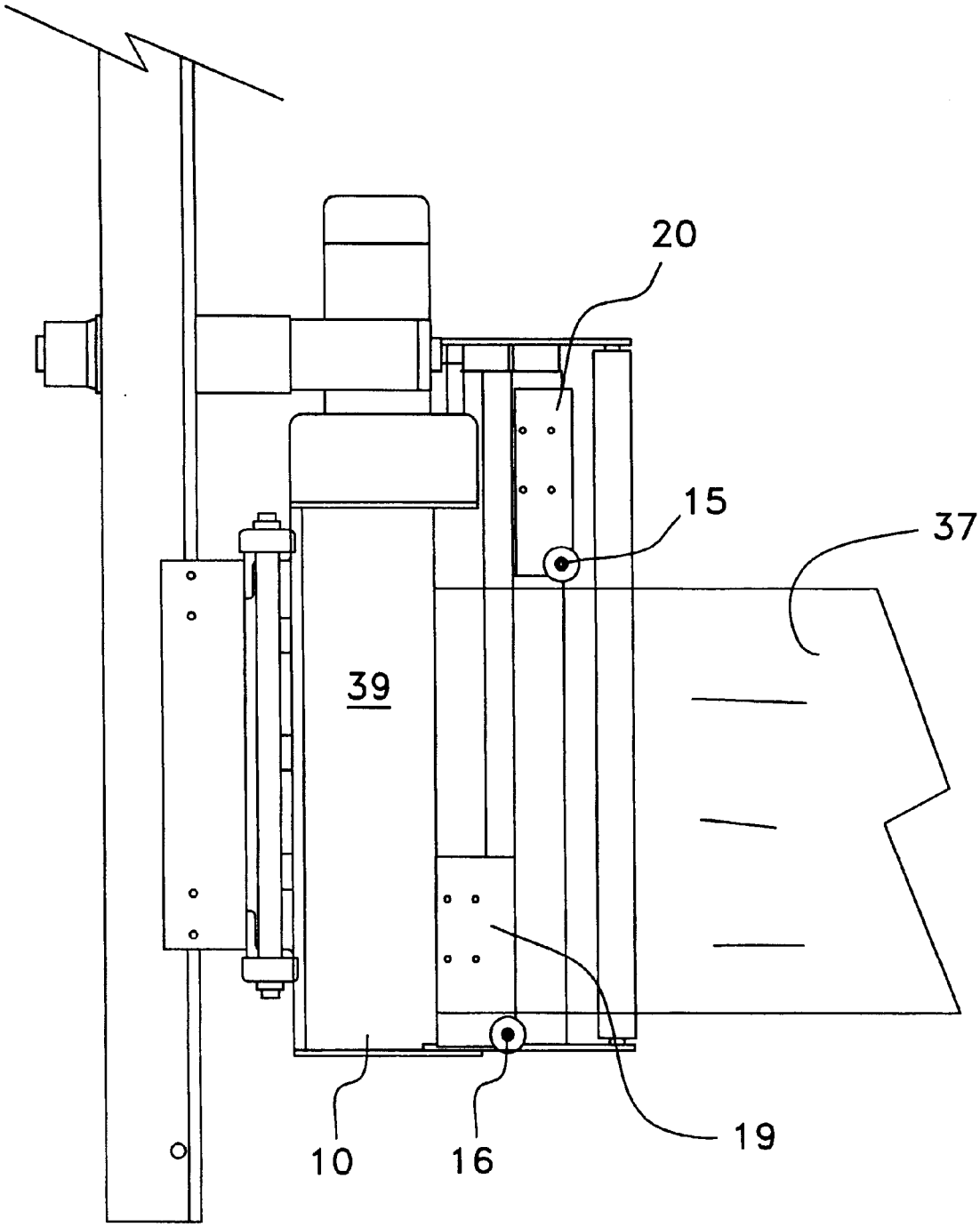
FIG. 7 is an enlarged view of a part of the machine shown in FIG. 3, in a first operating position.
Figure 8:
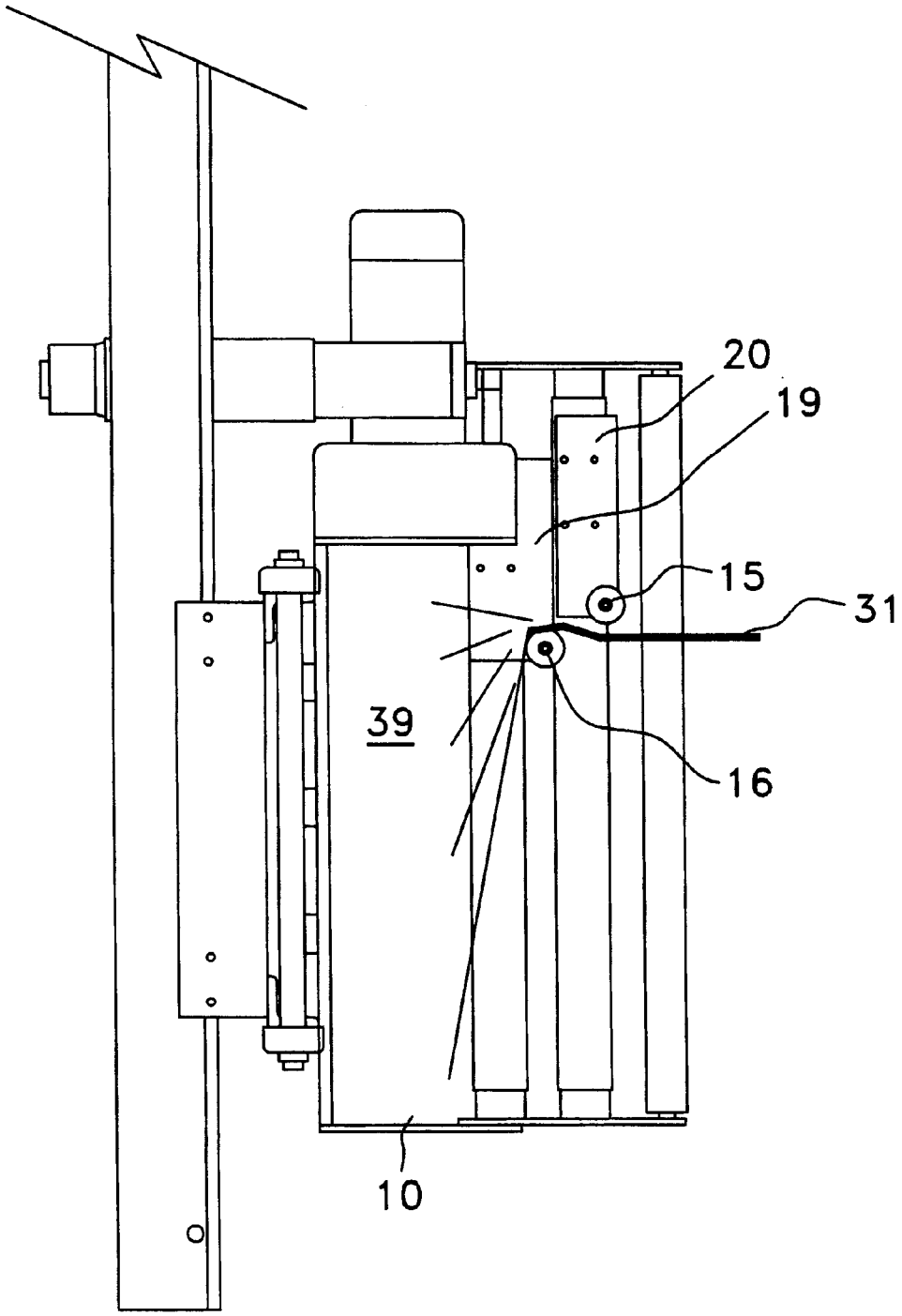
FIG. 8 is a view of the part shown in FIG. 7, in a second operating position.
Figure 9:
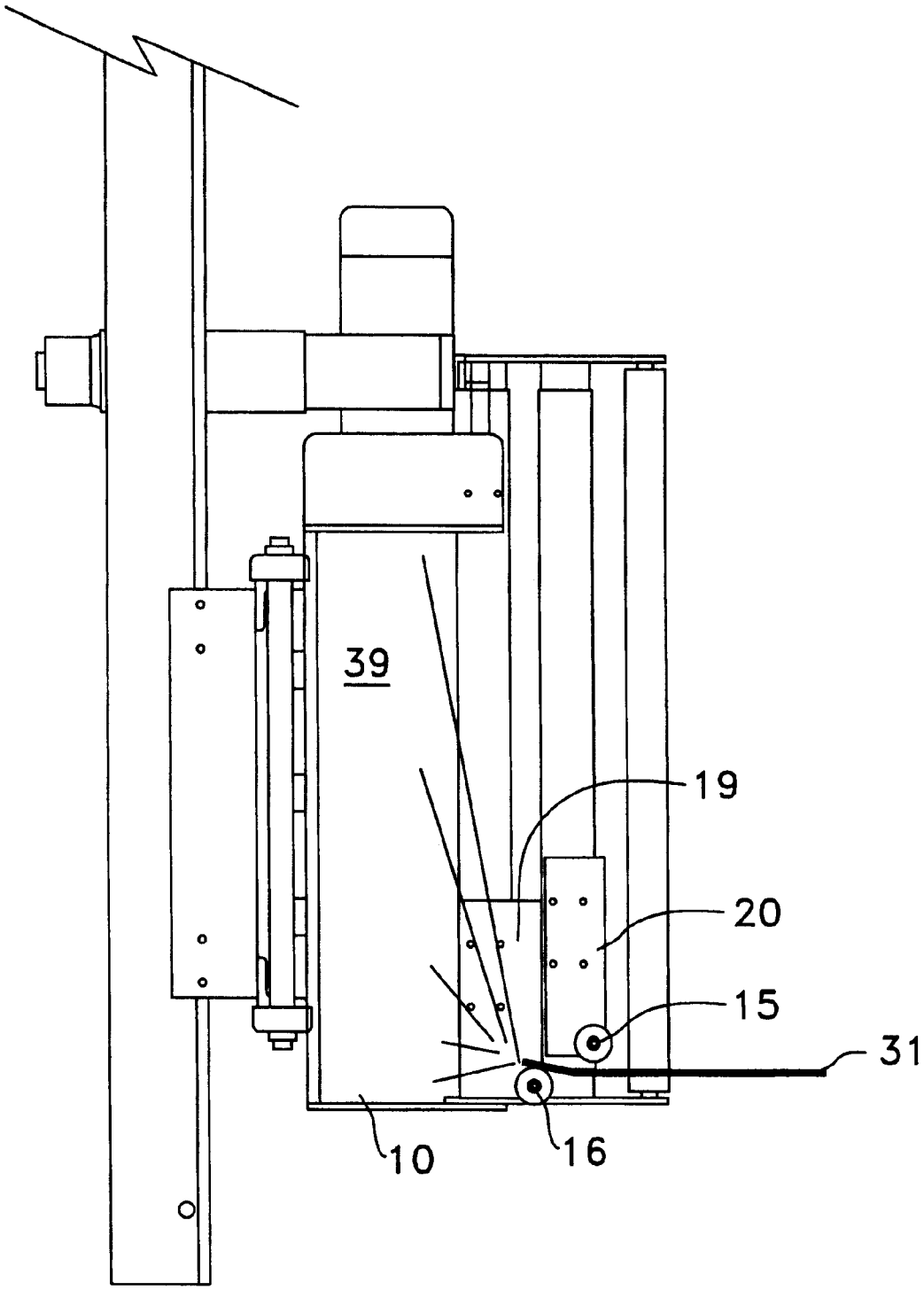
FIG. 9 is a view of the part shown in FIG. 7, in a third operating position.

Referring now to FIGS. 4 to 9, there is as shown with more details the delivering carriage 5 shown in FIGS. 1 to 3. The delivering carriage includes the output delivering device which is provided with a guiding cylindrical roller 18 for guiding the film 39 from the roll 10 along a plan toward a predetermined direction. The output delivering device also comprises two elements 15 and 16. These two elements 15 and 16 are movable along parallel axis within the plan, transversally to the predetermined direction. Each of the elements 15 and 16 being provided with a contact device which is a roping wheel for contacting lateral opposite edges of the film. The elements 15 and 16 are movable between a first operating position shown in FIG. 7 where the elements 15 and 16 are distant from each other to deliver the film 39 as a web 37, and a second operating position as shown in FIGS. 8 and 9 where the elements 15 and 16 are close to each other to deliver the film 39 as a rope 31.

Figure 22:
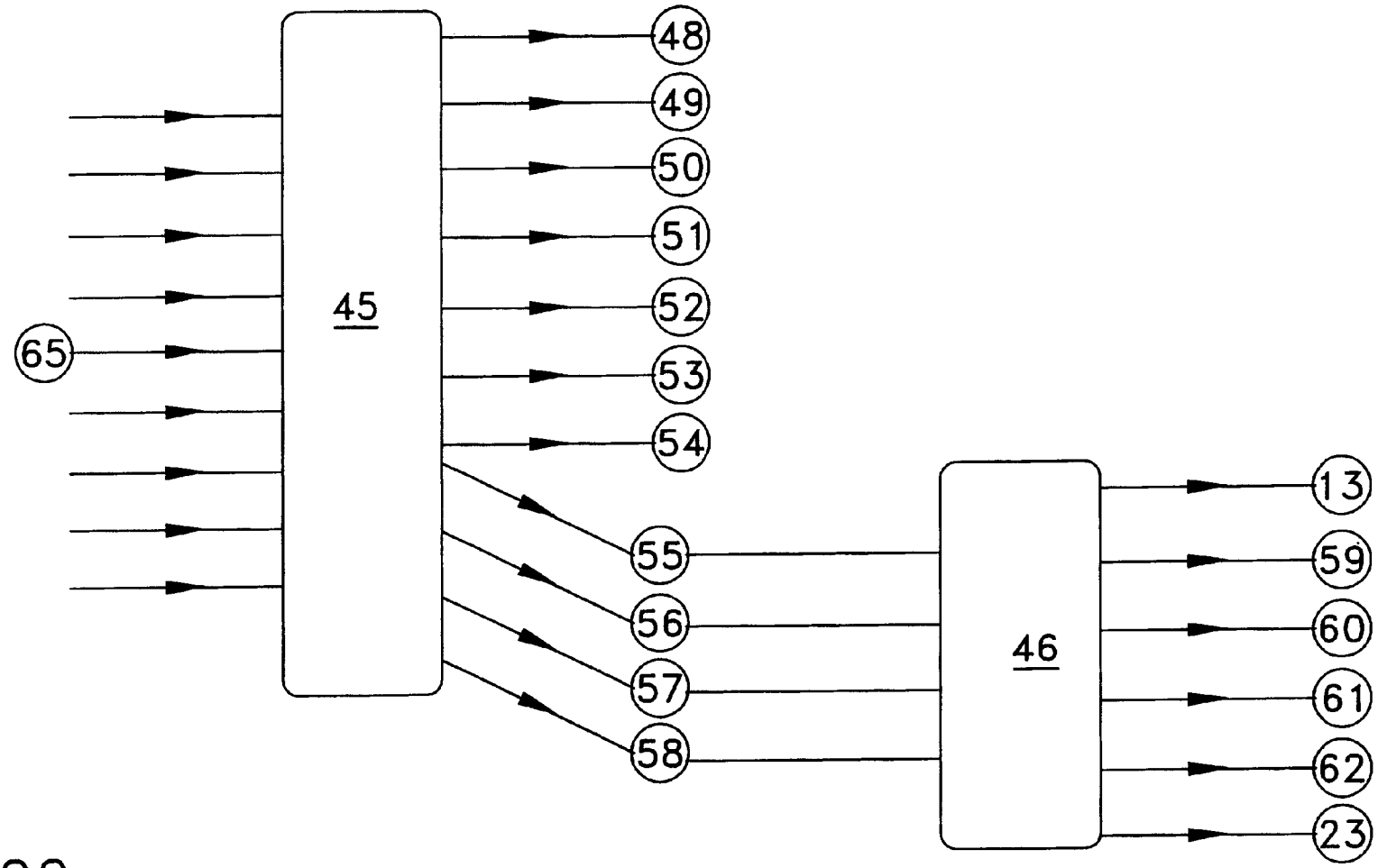
FIG. 22 is a schematic block diagram of the controller of the machine shown in FIGS. 1 to 3.

Controllable moving cylinders 19 and 20 are provided for moving the elements 15 and 16 between first and second operating positions as shown in FIGS. 7, 8 and 9. The controller shown in FIG. 22 is connected to cylinders 19 and 20 for controlling their movement.

Figure 4:
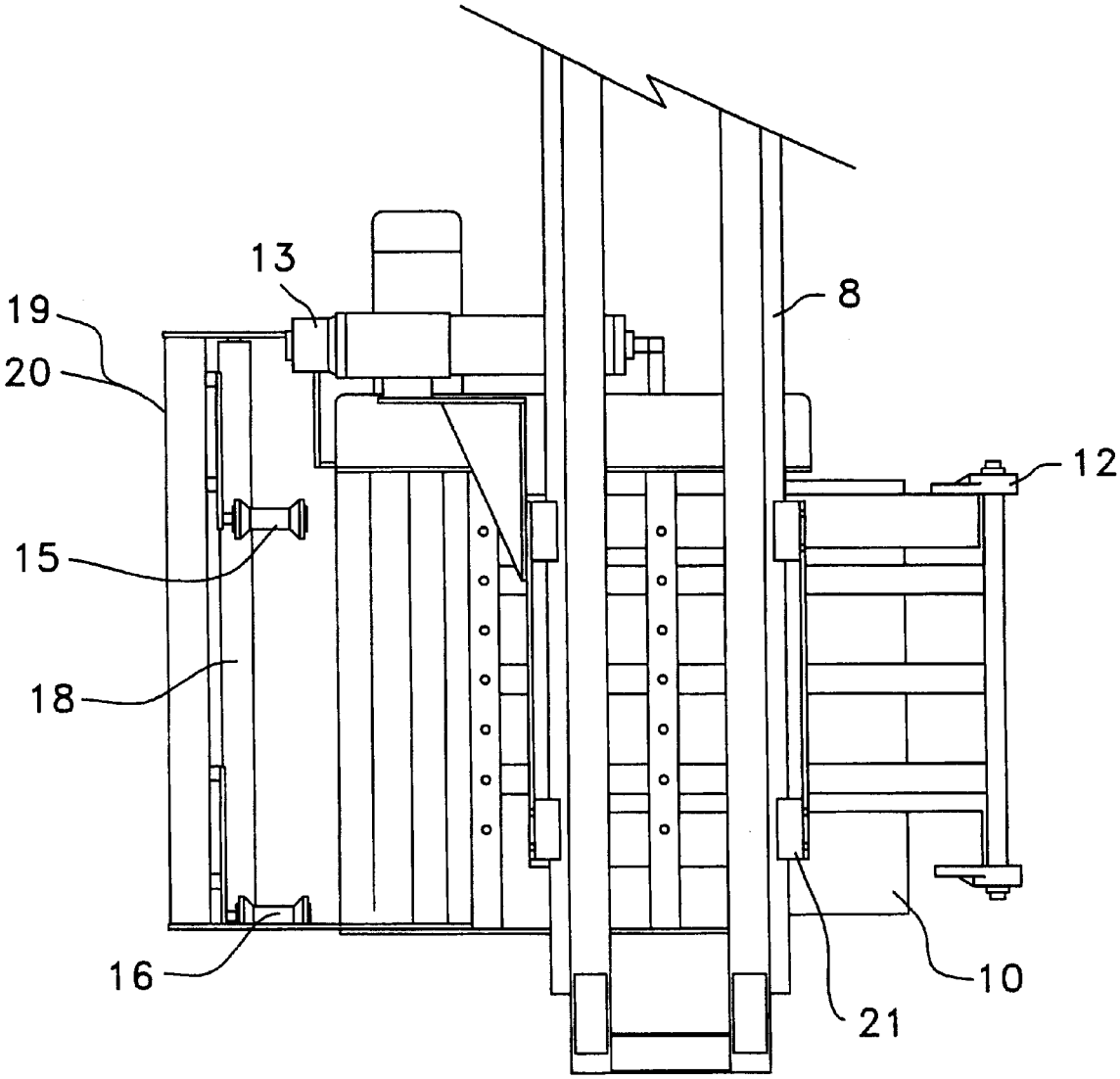
FIG. 4 is an enlarged view of a part of the machine shown in FIG. 2.
Figure 5:
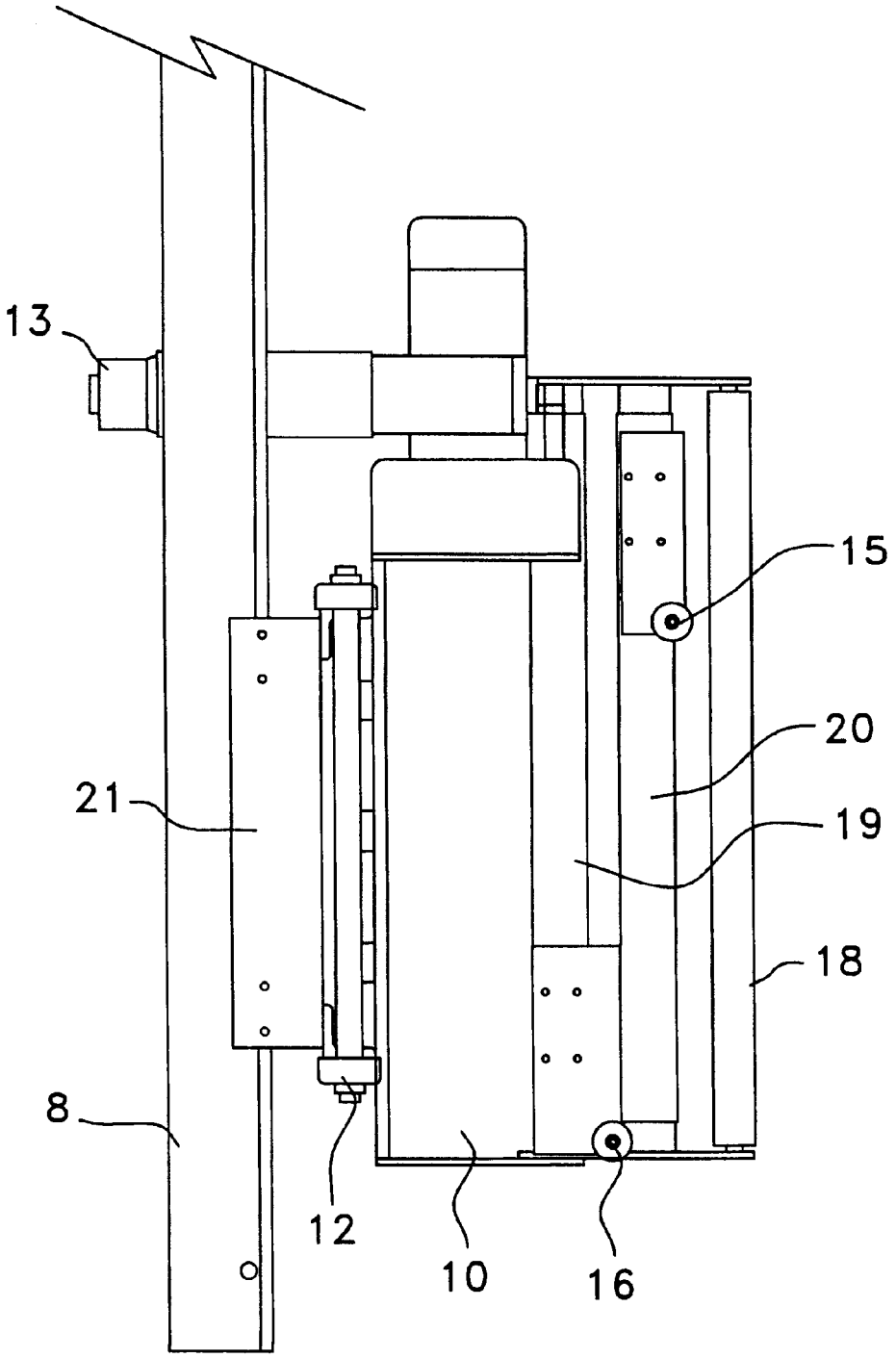
FIG. 5 is an enlarged view of a part of the machine shown in FIG. 3.

The controllable moving cylinders 19 and 20 are also used to embody the third controllable moving device by moving the elements 15 and 16 together along their axis when they are in their second operating position to produce the relative axial movement of the rope as shown in FIGS. 8 and 9. A sliding bracket 21 as shown in FIGS. 4, 5 and 6 is provided for sliding the delivering carriage with respect to the boom 8.

Referring now to FIGS. 10 to 13, there is shown that the delivering carriage comprises first and second parts 52 and 54 connected by means of a pivot axis 12. The first part 52 is connected to the boom 8 by means of the sliding bracket 21 shown in FIGS. 4, 5 and 6. The output delivering device is mounted on the second part 54. A controllable cylinder 13 is provided for pivoting the second part 54 with respect to the first part 52. The two extremities of the cylinder 13 are connected respectively to the first and second parts 52 and 54 of the delivering carriage. The relative radial movement of the output delivering means with respect to the central axis 50 is produced by means of the controllable cylinder 13 as shown more specifically in FIGS. 12 and 13. A motor 17 is provided on the boom 8 for moving the delivering carriage up and down the boom 8.

Figure 12:
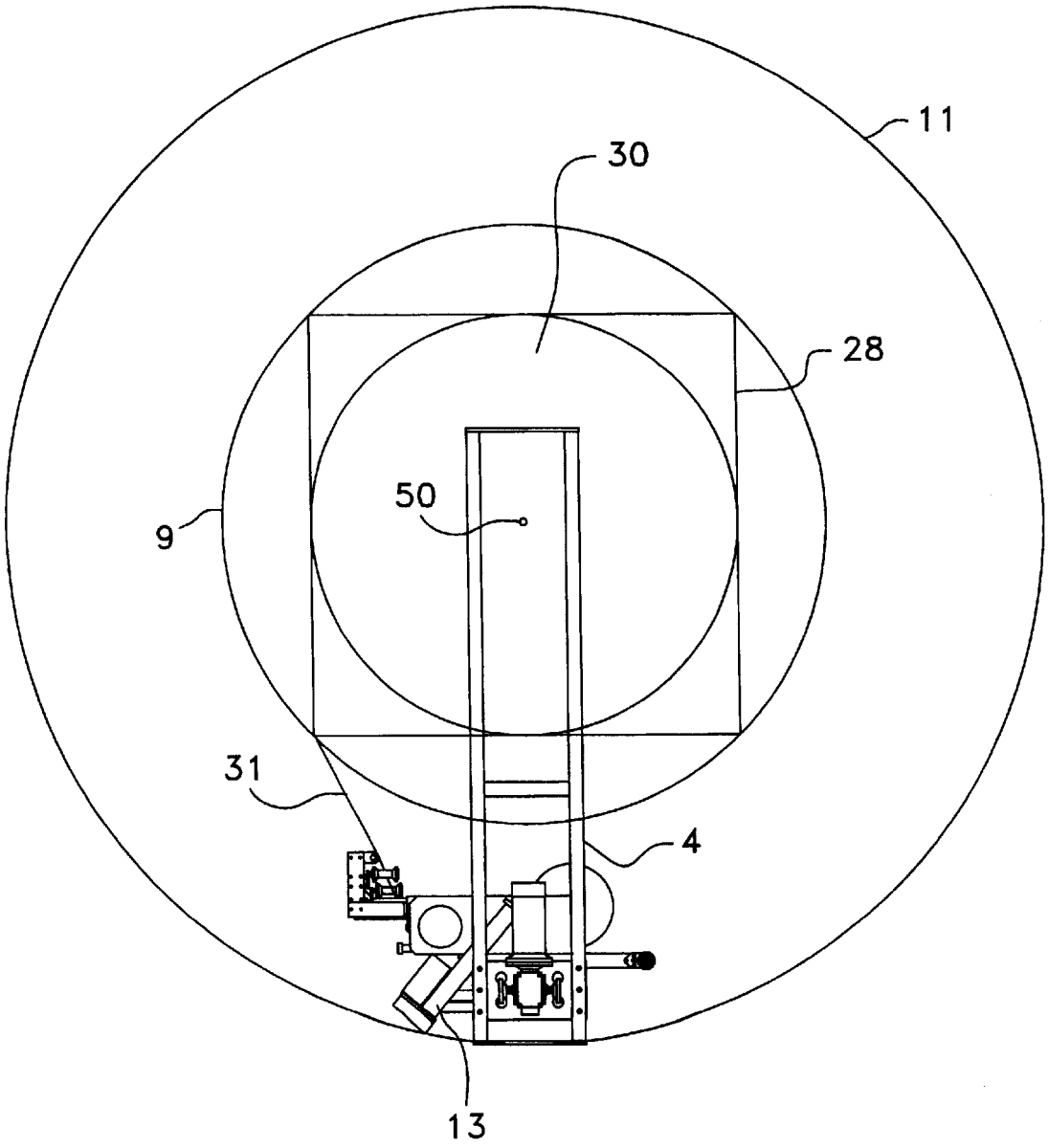
FIG. 12 is a schematic top view of a machine according to the present invention, in relation to a large load.
Figure 13:
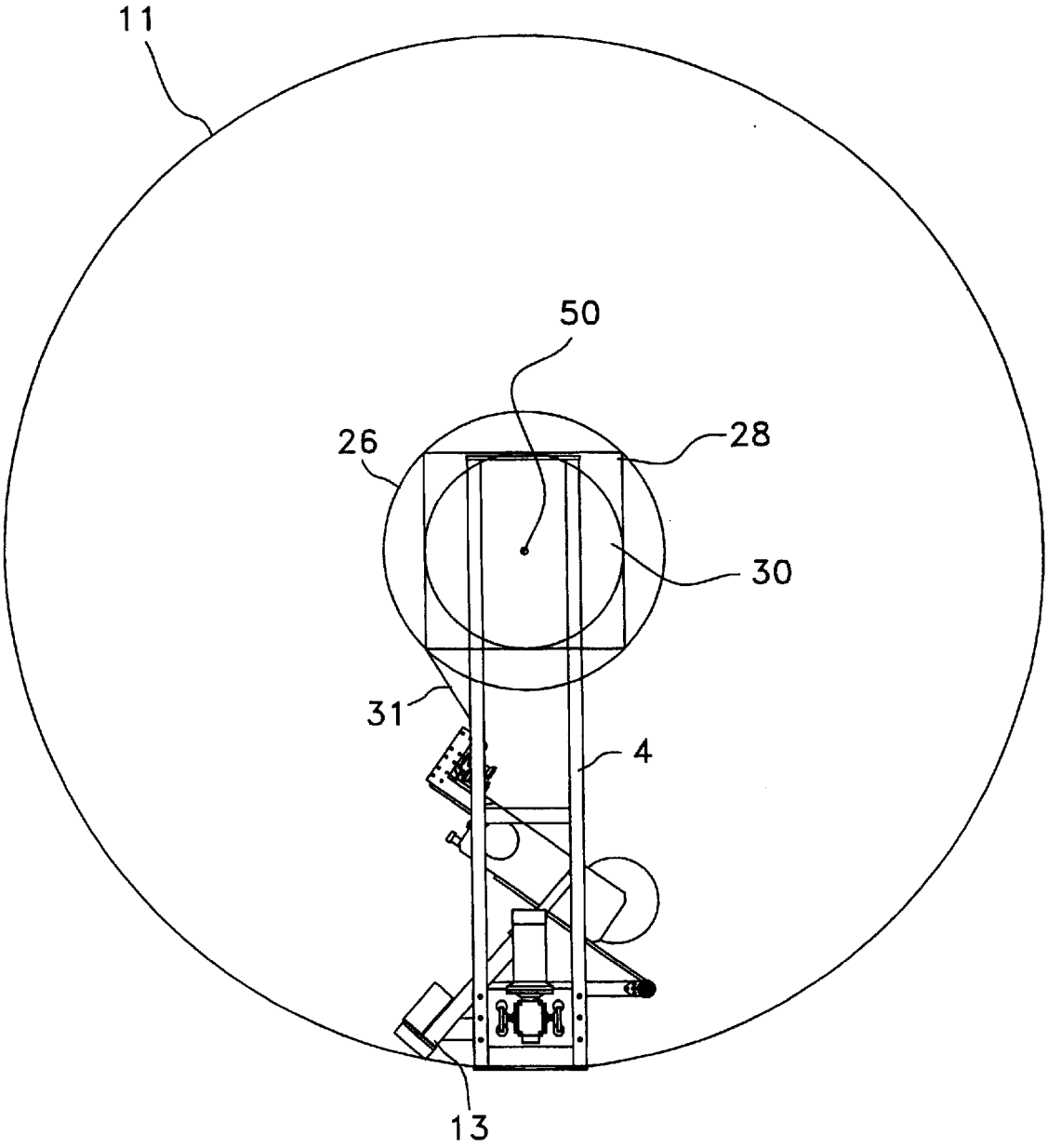
FIG. 13 is a schematic top view of a machine according to the present invention, in relation to a small load.

Referring now more specifically to FIGS. 12 and 13, there are shown two operating positions of the output delivering device for fastening respectively a large load and a small load. In each case, the load comprises an object 30 resting on a pallet 28. In FIG. 12, there is shown the maximum fastening diameter 9 that is allowed by the machine, and in FIG. 13 there is shown the minimum fastening diameter 26 allowed by the machine. It can be seen that the presence of the controllable cylinder 13 for producing the relative radial movement of the output delivering device allows the fastening of loads with a large range of sizes.

Referring now to FIGS. 14 to 17, we will now describe with more details the clamp unit 25 shown in FIGS. 2 and 3. In the prior art, a wrapping sequence begins and ends by clamping the film by means of the clamping unit which includes a clamp and a guiding bar. Normally, the clamp and the guiding bar are at fixed positions and this is not a problem because there is no radial movement of the output delivering device. But, according to the present invention, since the delivering carriage is movable along the radial direction with respect to the central axis, the jaws 35 of the clamp and the guiding bar 32 have to be removed from the way during a fastening sequence.

The jaws 35 and the guiding bar 32 are only needed at the beginning and at the end of a fastening cycle. During the fastening cycle, these elements are in a standby mode. However, they are right on the path of the output delivering device when the radial movement thereof is performed.

In order to overcome this drawback, controllable cylinders 34 and 36 are provided for moving the jaws 35 and the bar 32 out of the way during the fastening cycle so that the radial movement of the output delivering device is unobstructed. The jaws 35 and the guiding bar 32 are both mounted between a home position of the output delivering device and the central axis 50 shown in FIG. 1, for clamping the film at the beginning and end of the fastening cycle of the delivering carriage.

The controllable cylinder 36 is provided for moving the jaws 35 between a first position where, during the fastening cycle, the relative radial movement of the output delivering device with respect to the central axis is unobstructed, and a second position where the jaws 35 are in position to clamp the film at the beginning and end of the fastening cycle. The controllable cylinder 34 is provided for moving the guiding bar 32 between a first position where, during the fastening cycle, the relative radial movement of the output delivering device with respect to the central axis is unobstructed, and a second position where the guiding bar 32 guides the flexible material extending from the output delivering device in position so that a portion of the flexible material can be clamped by the jaws 35. The controller shown in FIG. 22 controls the operating positions of the jaws 35 and the guiding bar 32 by means of the controllable cylinders 34 and 36.

Figure 14:
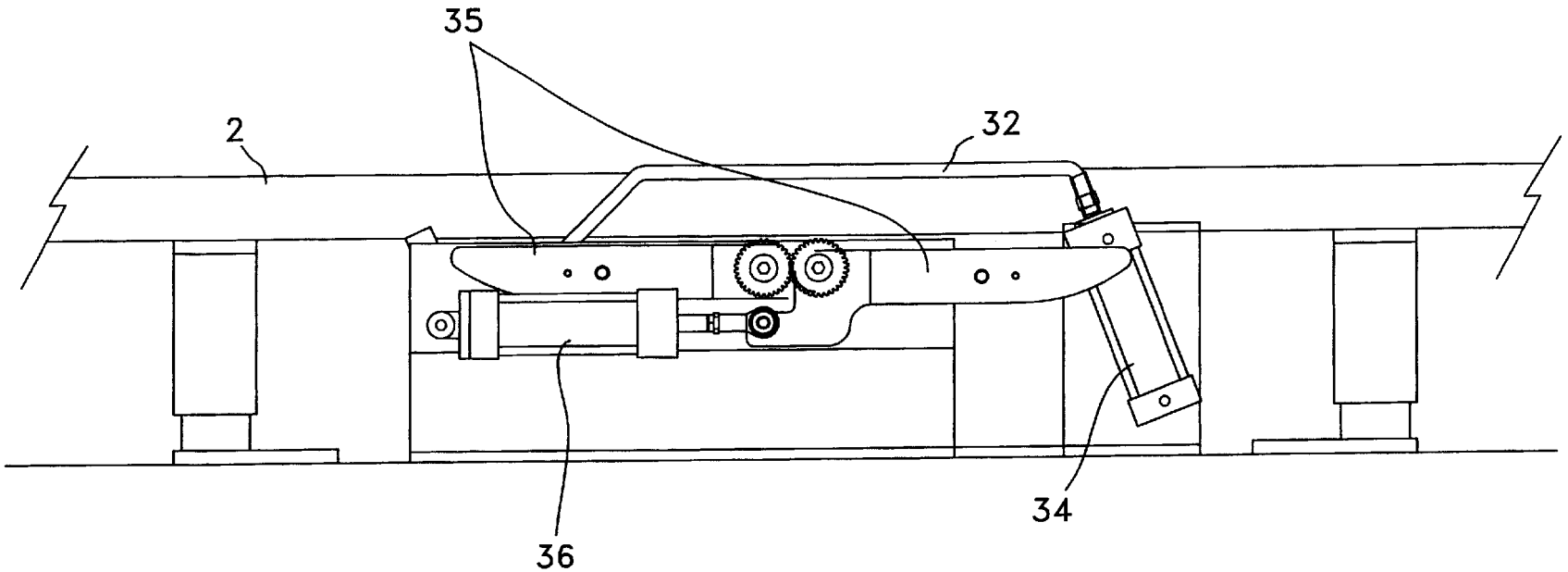
FIG. 14 is a side elevational view of a part of the machine shown in FIG. 2, in a first operating position.
Figure 16:
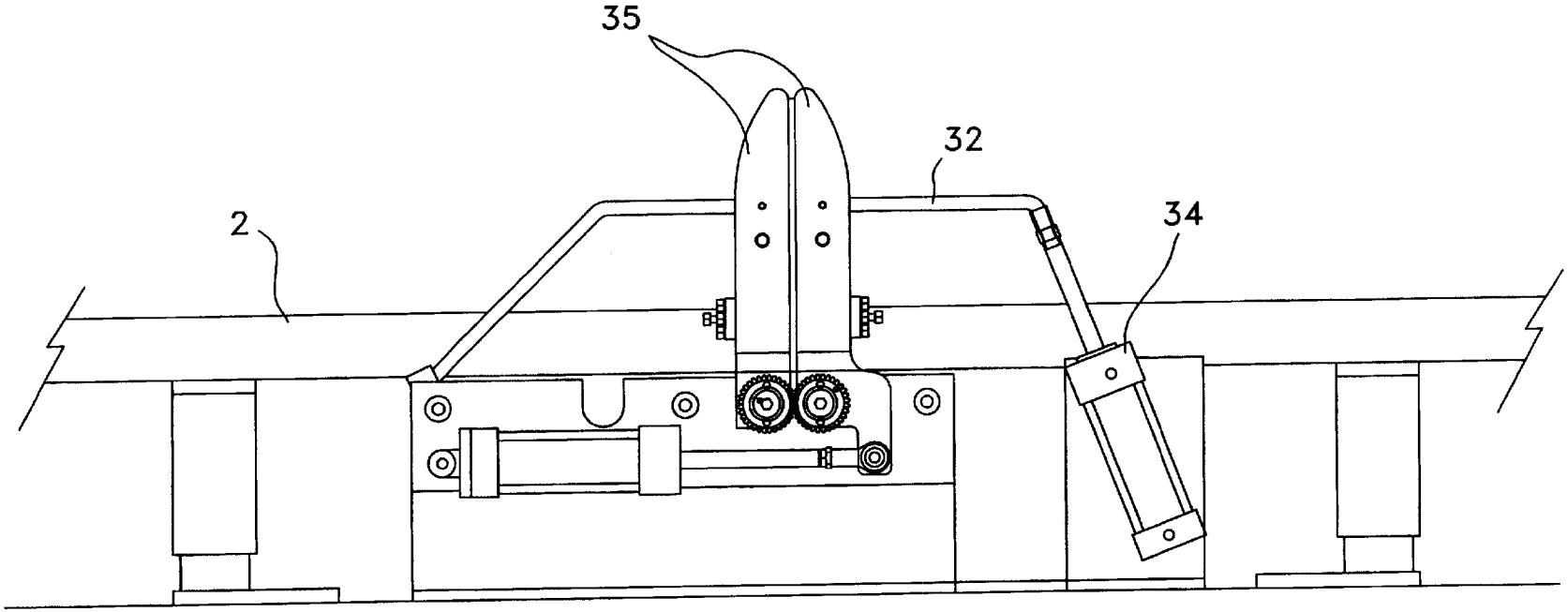
FIG. 16 is a side elevational view of the part shown in FIGS. 14 and 15, in a second operating position.

In the first operating position of the clamp, the jaws 35 are 180° apart from each other as shown in FIG. 14. In the second operating position of the clamp, the two movable jaws 35 are adjacent to each other as shown in FIG. 16.

Figure 15:
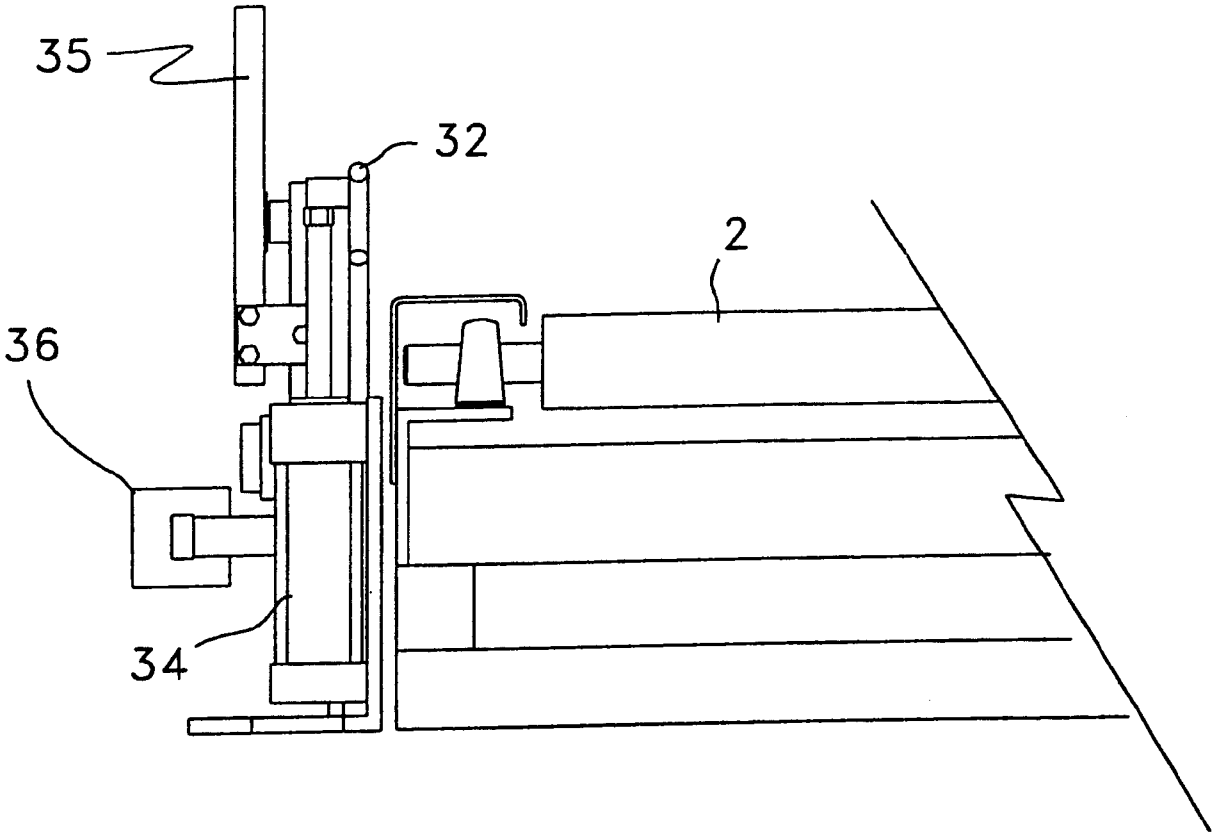
FIG. 15 is a rear elevational view of the part shown in FIG. 14.

The guiding bar 32 has a horizontal upper central portion terminated by diverging lower extremities. The horizontal central portion moves between a lower position bar as shown in FIGS. 14 and 15, and an upper position as shown in FIGS. 16 and 17. The controllable cylinder 34 is connected to one of the extremities of the guiding bar 32 to move the central portion thereof between its lower and upper positions.

Figure 18:
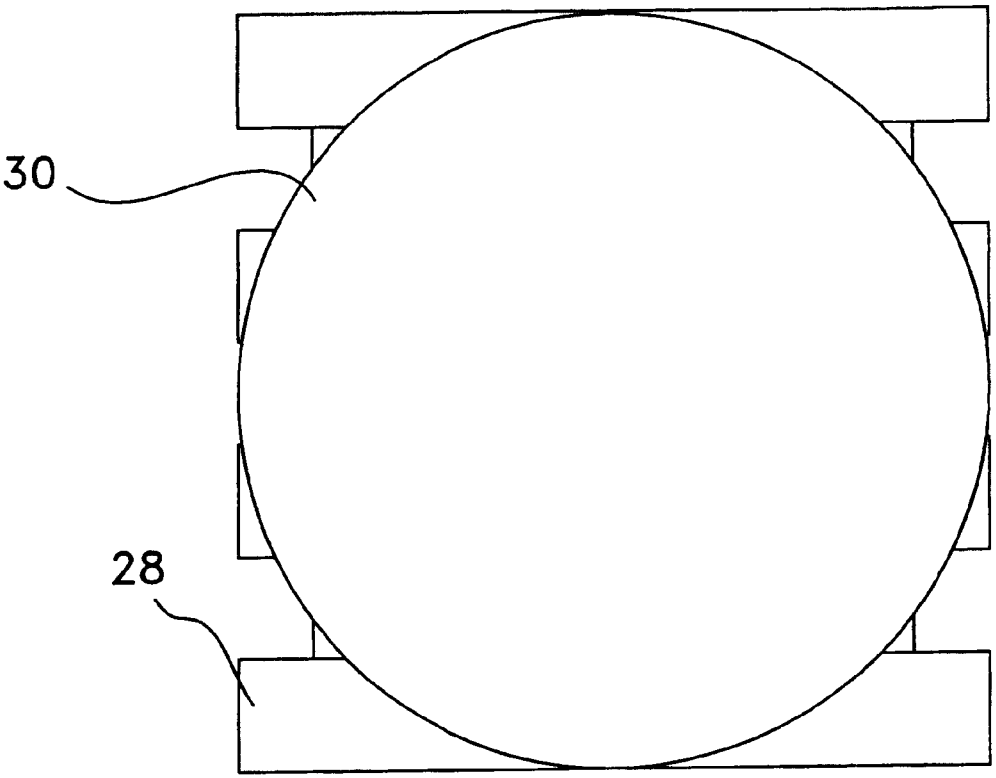
FIG. 18 is a top view of a load.

According to the present invention, there is also provided a method for fastening a load. To describe this method, we will now refer to FIGS. 1, 8, 9, 13 and 18 to 21. In FIG. 18, there is shown a top view of the load which comprises an object 30 resting on a pallet 28.

The method comprises the steps of (a) bringing the load to a point intersected by a central axis 50 as shown in FIG. 1; (b) after step (a), producing a relative radial movement of the output delivering device with respect to the central axis 50 in view of the size of the load as shown for example in FIG. 13; (c) delivering the film 39 as a rope 31 by means of the output delivering device as shown for example in FIG. 8; (d) after steps (b) and (c), producing a relative rotating movement of the rope with respect to the central axis; and (e) during step (d) producing a relative axial movement of the rope 31 in a direction parallel to the central axis as shown for example in FIGS. 8 and 9 to fasten the load with the rope 31 by means of the relative rotating and axial movement thereof as shown in FIGS. 19, 20 and 21.

Figure 19:
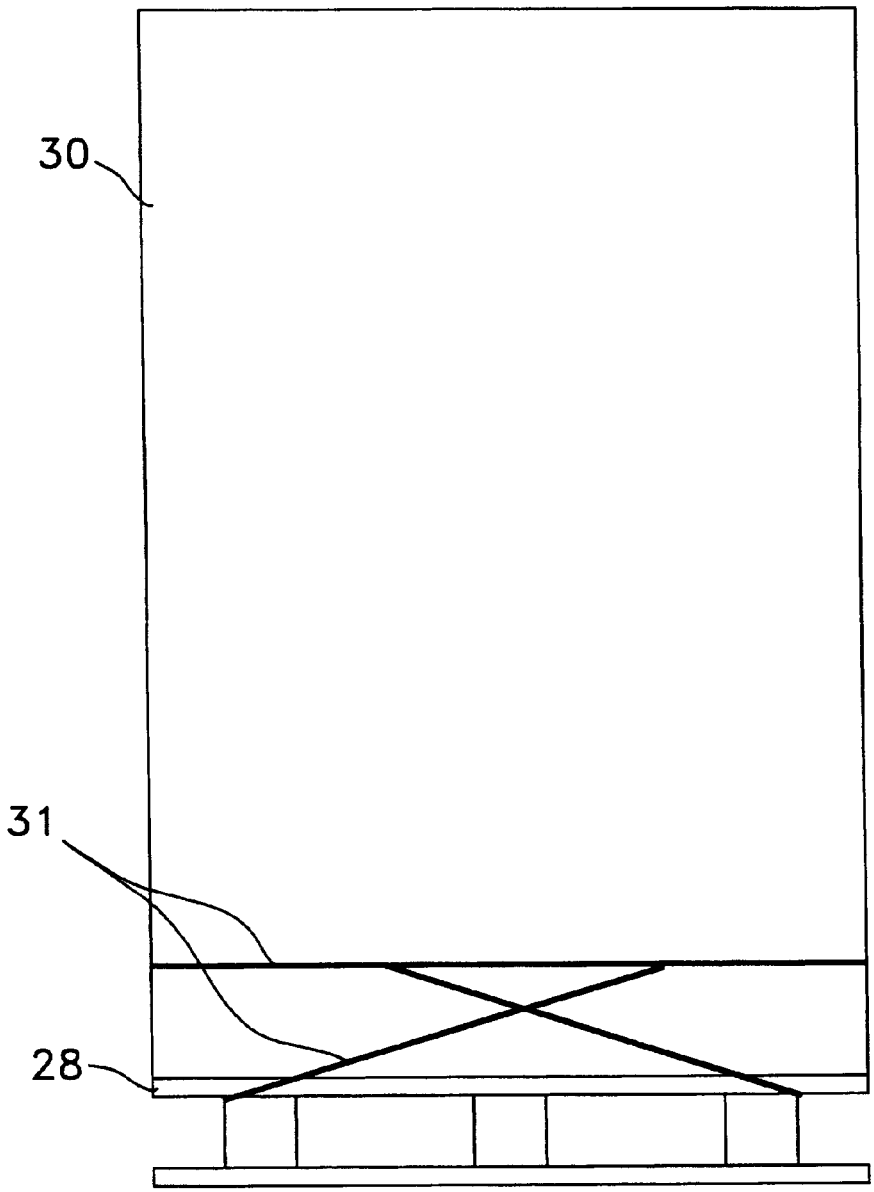
FIG. 19 is a front elevational view of the load during the fastening thereof.
Figure 20:
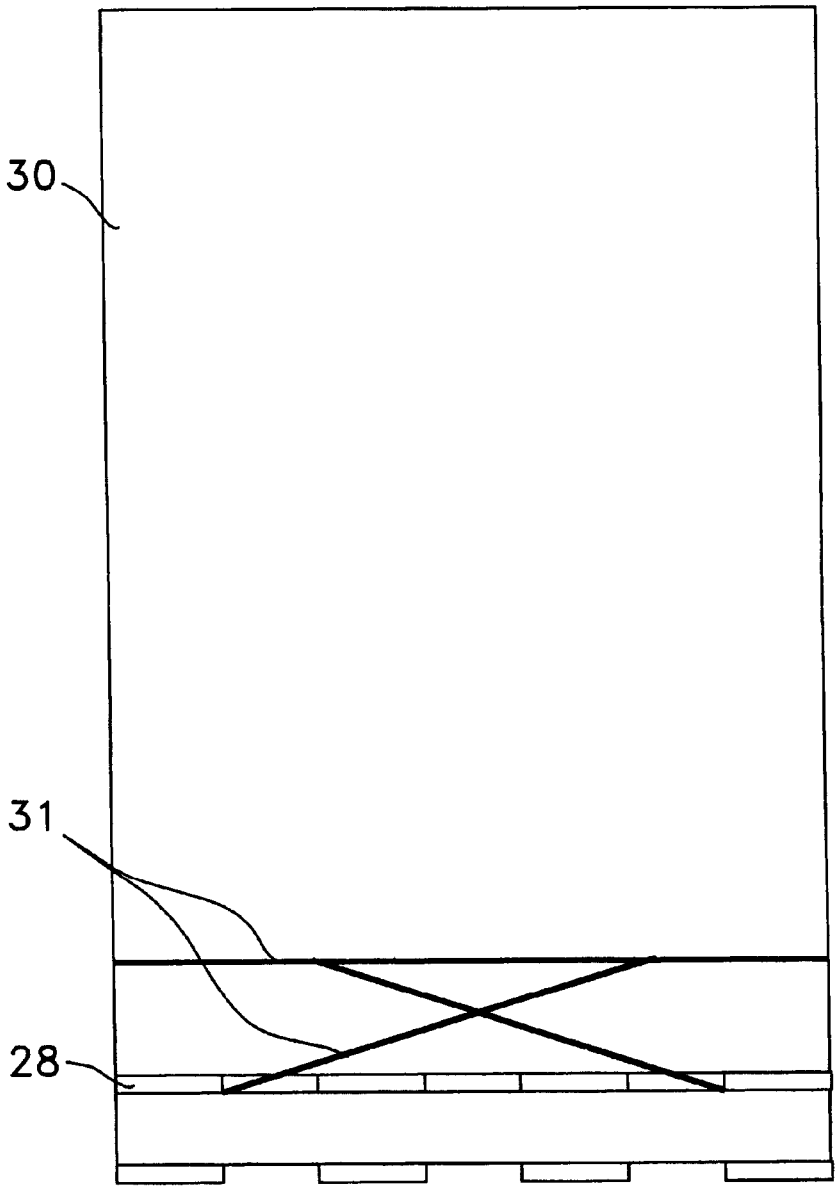
FIG. 20 is a side elevational view of the load during the fastening thereof.
Figure 21:
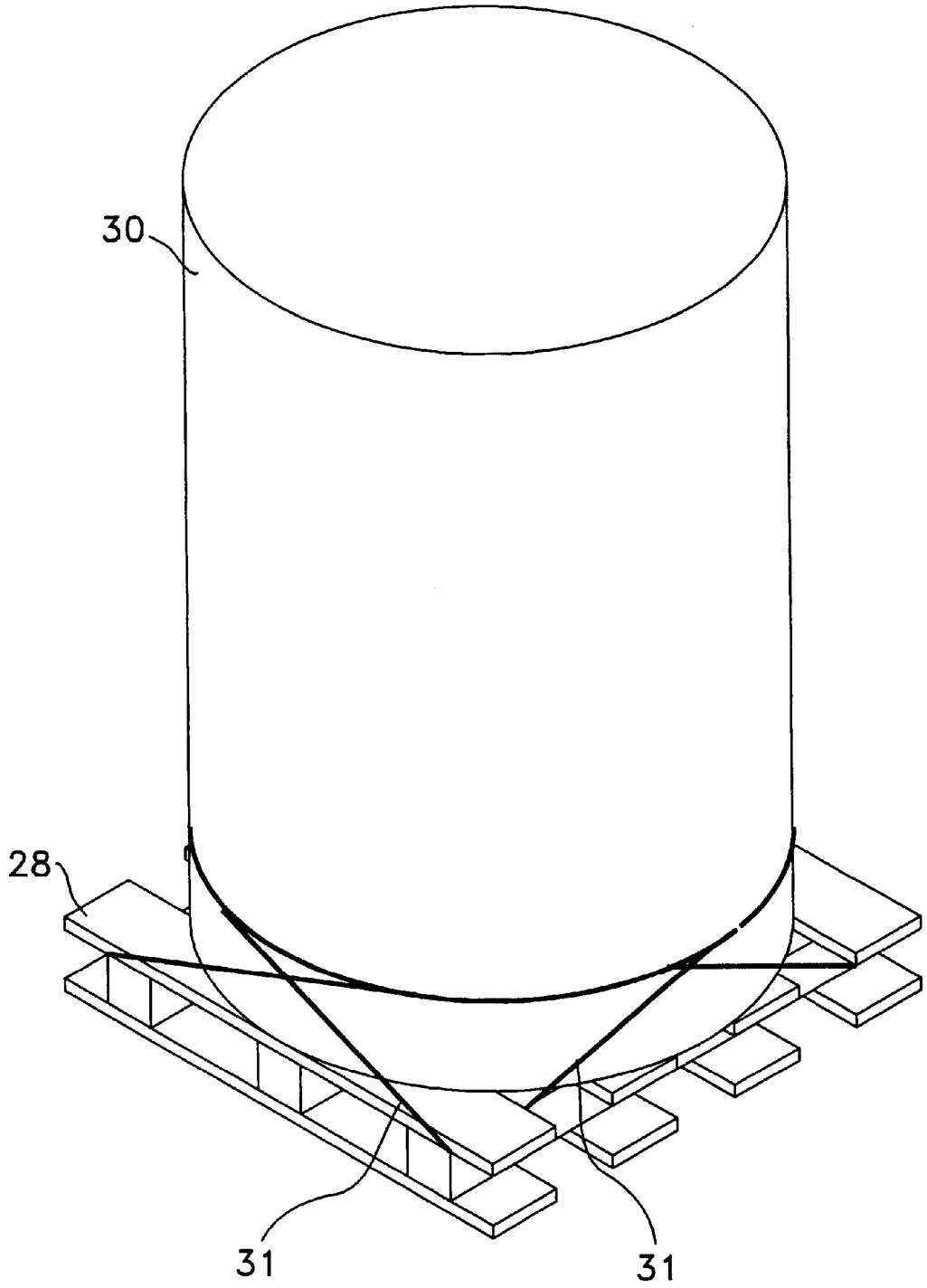
FIG. 21 is a perspective view of the load from above during the fastening thereof.

In these FIGS. 19, 20 and 21, we can see that the pallet 28 has four corners and a top board on which the object 30 is resting. Preferably, for each corner of the pallet 28, the relative axial movement of step (d) includes a downward movement to pass the rope 31 underneath the top board of the pallet 28 at said corner, followed by an upward movement of the rope above the pallet 28 for at least one full turn thereof around the object, as seen more specifically in FIG. 21.

Preferably, the method further comprises, after step (b) and before step (c), steps of (i) delivering the film as a web by means of the output delivering device as shown in FIG. 7; (ii) after step (i) producing a relative rotating movement of the web with respect to the central axis; and (iii) during step (ii), producing a relative axial movement of the web in a direction parallel to the central axis to wrap the load with at least one layer of the web by means of the relative rotating and axial movements thereof. In some cases, the fact that the load is wrapped before the fastening provides some advantages.

Preferably, the method further comprises, after step (e), step of (iv) delivering the film as a web by means of the output delivering device as shown in FIG. 7; (v) after step (iv), producing a relative rotating movement of the web with respect to the central axis; and (vi) during step (v), producing a relative axial movement of the web in a direction parallel to the central axis to wrap the load with at least one layer of the web by means of the relative rotating and axial movements thereof. In some cases, the fact that the load is wrapped after the fastening thereof provides several advantages.

We will now describe a preferable embodiment of the method with more details, with reference to FIGS. 1, 2, 3, 10 and 11. In the present case, the load 3 is made of a metal coil resting on a pallet. The load is brought with a conveyor 2. While the load is entering the wrapping area, it is detected and measured by means of a photo eye 22. This measurement is used to stop the load in alignment with the central axis 50 of the machine. According to the same measurement, the machine decides whether the size of the load is such that the output delivering device of the carriage 5 has to be repositioned in relation to the central axis 50. If the output delivering device has to be repositioned, it will be moved by means of the servo-drive ball screw cylinder 13. This cylinder 13 can stop at different positions between its retracted and completely extended positions.

At the beginning of a cycle, the film end is secured between the jaws of the clamping unit 25. The cycle begins with a wrapping sequence to wrap the load 3. The wrapping of the load is preferable to make sure that the rope will stay in position after the fastening sequence.

After the wrapping sequence, the film has to be delivered as a rope. Referring now to FIGS. 8 and 9, we will describe how the film is delivered as a rope, and how the rope is moved up and down. During the wrapping sequence, the cylinders 19 and 20 are positioned as shown in FIG. 7. It is possible to deliver the film as a rope by bringing up cylinder 19 close to cylinder 20 as shown in FIG. 8. In a similar manner, it is also possible to deliver the film 39 as a rope 31 by bringing down cylinder 20 close to cylinder 19 as shown in FIG. 9. By using both cylinders 19 and 20 simultaneously, it is possible to move the rope 31 up and down without any movement of the delivering carriage.

Referring to FIGS. 1, 2, 3, 7, 8, 9, 19, 20 and 21, at the end of wrapping sequence, the delivering carriage returns at its lowest position on the boom 8 to start a fastening sequence. Then, the cylinders 19 and 20 are moved to deliver the film 39 as a rope 31. Then, by controlling the rotative movement of the delivering carriage 5 around the load 3 and by controlling the movement of the cylinders 19 and 20, it is possible, for each corner of the pallet 28, to pass the rope 31 underneath it and then make at least one full turn of the rope 31 around the load 3. This operation is repeated for each corner of the pallet 28. The user can select the number of turns around the load for each corner of the pallet.

When the rope sequence is done, both cylinders 19 and 20 are brought to their home position so that the film 39 is now delivered as a web 37 as shown in FIG. 7. Then several revolutions of the full web is done to cover the rope 31 with at least one layer of web 37. After this final wrapping sequence, the delivering carriage 5 is brought back to its home position where the film 39 is clamped by the clamp unit 25 and cut and wipe by means of the cut and wipe unit 42 to free the load 3. The load 3 is removed from the fastening area and a next one can be brought in.

Referring now to FIG. 22, there is shown a block diagram of the controller. The controller comprises a central module 45 and a peripheral module 46 which is only concerned with the control of the radial movement of the output delivering device of the delivering carriage. The input 65 of the module 45 is for receiving a signal from the photo eye 22 shown in FIG. 1. Output 48 of module 45 is for controlling the rotation of the delivering carriage around the load by means of the motor 43 shown in FIG. 1. The outputs 49 and 50 are for controlling the up and down movement of the delivering carriage by means of the motor 17 shown in FIG. 10. The outputs 51, 52, 53 and 54 of module 45 are for controlling the cylinders 19 and 20 shown in FIGS. 7, 8 and 9 to deliver the film as a web or a rope and to further move the rope up and down.

Figure 10:
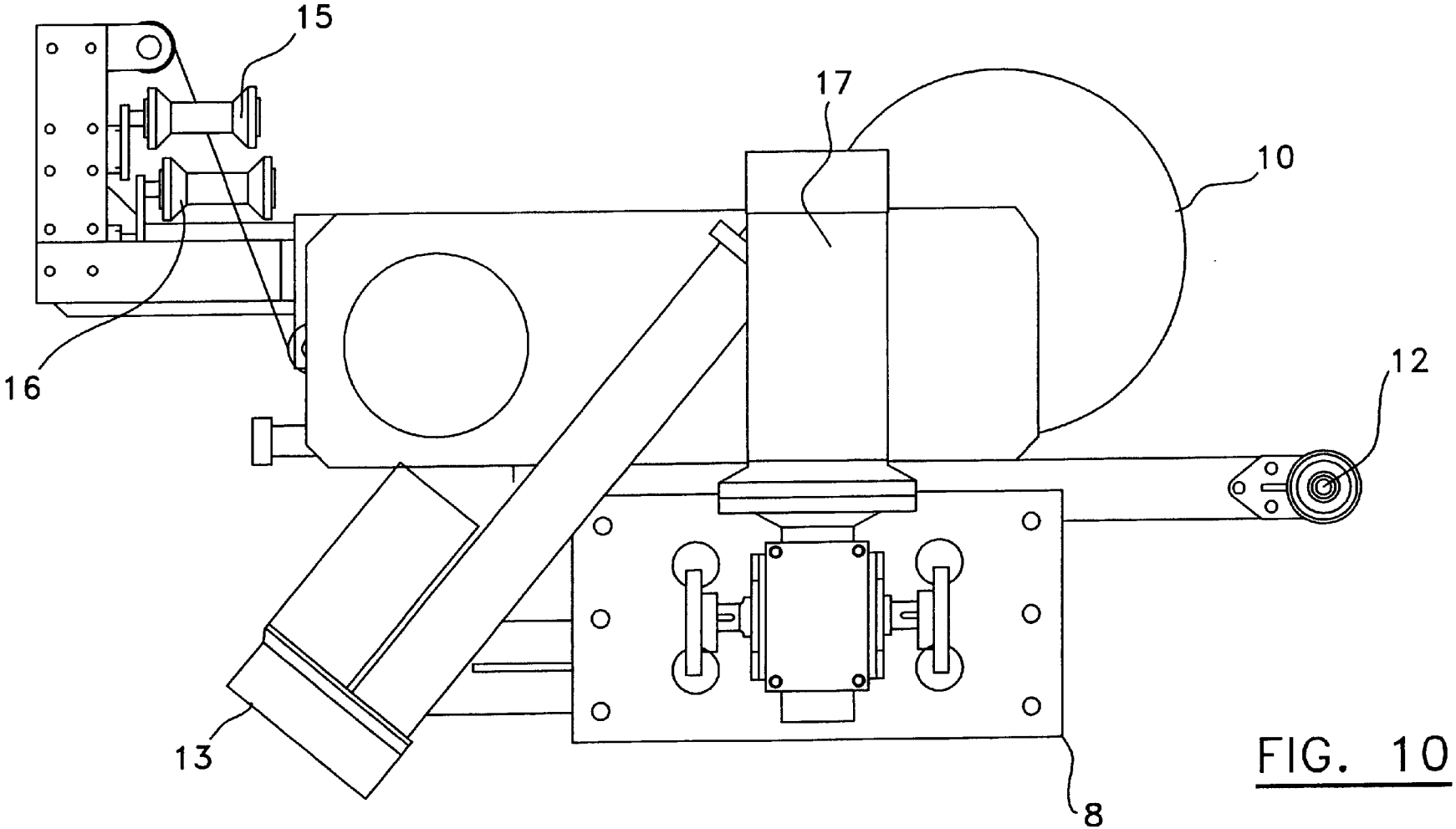
FIG. 10 is an enlarged view of a part of the machine shown in FIG. 1, in a first operating position.
Figure 11:
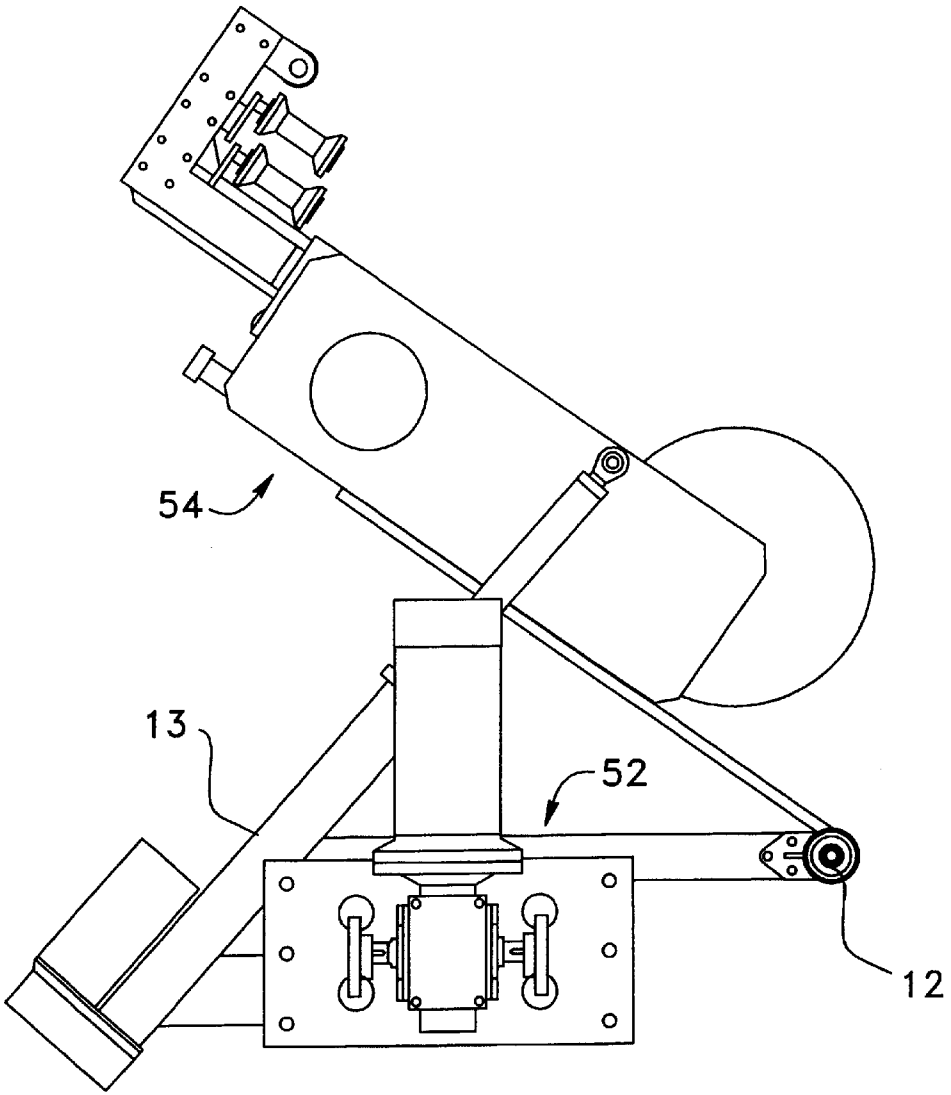
FIG. 11 is a view of the part shown in FIG. 10, in a second operating position.

Output signals 55, 56, 57 and 58 of the module 45 are sent to inputs of module 46 which provides by means of its outputs 59 to 64 control signals for controlling radial movement of the output delivering device of the delivering carriage by means of controllable cylinder 13 shown in FIGS. 10 and 11. Each of the outputs 59 to 64 corresponds to a different radial position of the output delivering device with respect central axis.

Although a preferred embodiment of the invention has been described in detail herein and illustrated in the accompanying drawings, it is to be understood that the invention is not limited to this precise embodiment and that various changes and modifications may be effected therein without departing from scope or spirit of the invention.

What is claimed is:

1. A machine for fastening a load having a given size, comprising:

a machine frame positioned around a central axis intersecting a point where, in operation, the load is brought;

a delivering carriage onto which a roll of flexible material is rotatively mountable, including an output delivering means for delivering the flexible material as a rope, the delivery carriage comprising first and second parts connected by means of a pivot axis, the first part being connected to a movable support, the output delivering means being mounted on the second part;

first controllable moving means for producing a relative radial movement of the output delivering means with respect to the central axis, the first controllable moving means comprising a controllable cylinder having two extremities connected respectively to the first and second parts of the delivering carriage for pivoting the second part with respect to the first part by means of the pivot axis to produce the relative radial movement of the output delivering means with respect to the central axis relative rotating movement of the rope with respect to the central axis;

a second controllable moving means for producing a relative rotating movement of the rope with respect to the central axis, the second controllable moving means comprising a motor, a ring gear connected to the motor and mounted within a gearbox, a rotary arm connected to the ring gear, and a boom onto which the delivering carriage is mounted so that the relative rotating movement of the rope with respect to the central axis is produced by rotating the delivering carriage by means of the motor;

a third controllable moving means for producing a relative axial movement of rope in a direction parallel to the central axis; and controlling means for controlling:

the relative radial movement by means of the first controllable moving means in view of the size of the load; and the relative rotating and axial movements by means of the second and third controllable moving means to fasten the load with the rope once the radial movement has been produced.

2. A machine according to claim 1, wherein:

the output delivering means comprise:

a guiding cylindrical roller for guiding the flexible material from the roll along a plan toward a predetermined direction;

two elements movable along parallel axes within the plan, transversally to said direction, each of the elements being provided with a contact means for contacting lateral opposite edges of the flexible material, the elements being movable between a first operating position where the elements are distant from each other to deliver the flexible material as a web, and a second operating position where the elements are closed to each other to deliver the flexible material as a rope; and a fourth controllable moving means for moving the elements between the first and second operating positions;

the controlling means is also for controlling the operating positions of the elements of the output delivering means by means of the fourth controllable moving means.

3. A machine according to claim 2, wherein the fourth controllable moving means is also used to embody the third controllable moving means by moving the elements together along their axis when said elements are in their second operating position to produce the relative axial movement of the rope.

4. A machine according to claim 2, comprising:

a clamp having two movable jaws and a guiding bar both mounted between a home position of the output delivering means and the central axis for clamping the flexible material at the beginning or end of a fastening cycle of the delivering carriage;

a fifth controllable moving means for moving the jaws between a first position, during the fastening cycle, where the relative radial movement of the output delivering means with respect to the central axis is unobstructed, and a second position where the jaws are in position to clamp the flexible material at the beginning or end of the fastening cycle; and a sixth controllable moving means for moving the guiding bar between a first position, during the fastening cycle, where the relative radial movement of the output delivering means with respect to the central axis is unobstructed, and a second position where the guiding bar guides the flexible material extending from the output delivering means in position so that, in operation at the beginning or end of the fastening cycle, a portion of the flexible material is clamped by the jaws;

wherein the controlling means is also for controlling the operating positions of the jaws and the guiding bar by means of the fifth and sixth controllable moving means.

5. A machine according to claim 4, wherein:

the two movable jaws which are 180° apart from each other in their first position, and adjacent to each other in their second position; and the fifth controllable moving means comprise a controllable cylinder for moving the jaws between first and second positions thereof.

6. A machine according to claim 4, wherein:

the guiding bar has a horizontal upper central portion terminated by diverging lower extremities, the horizontal upper central portion being in a lower position when the guiding bar is in its first position, and in an upper position when the guiding bar is in its second position; and the sixth controllable moving means comprise a controllable cylinder connected to one of the extremities of the guiding bar to move the central portion thereof between its lower and upper positions.

7. A machine according to claim 1, further comprising a photocell mounted in a position nearby the point where the load is located, for producing an output signal in relation to the size of the load, the photocell having an output connected to the controlling means for sending the output signal thereto.

* * * * *